US012251026B2

(12) United States Patent
Maurer

(10) Patent No.: US 12,251,026 B2
(45) **Date of Patent: *Mar. 18, 2025**

(54) BED COVER RETENTION APPARATUS

(71) Applicant: Scott D. Maurer, Asheville, NC (US)

(72) Inventor: Scott D. Maurer, Asheville, NC (US)

( * ) Notice: Subject to any disclaimer, the term of this patent is extended or adjusted under 35 U.S.C. 154(b) by 176 days.

This patent is subject to a terminal disclaimer.

(21) Appl. No.: 17/850,402

(22) Filed: Jun. 27, 2022

(65) Prior Publication Data

US 2022/0322841 A1 Oct. 13, 2022

Related U.S. Application Data

(63) Continuation-in-part of application No. 16/990,700, filed on Aug. 11, 2020, now Pat. No. 11,382,435.

(51) Int. Cl.
*A47C 21/02* (2006.01)

(52) U.S. Cl.
CPC ..... *A47C 21/022* (2013.01)

(58) Field of Classification Search
CPC ... A47C 21/022; A47C 21/028; A47C 21/024; A47C 21/02; Y10T 24/23
USPC ..... 5/498; 24/72.5
See application file for complete search history.

(56) References Cited

U.S. PATENT DOCUMENTS 2,223,412 A * 12/1940 Gartz ..... A47C 21/022 24/72.5
2,321,394 A * 6/1943 King ..... A47C 21/022 24/72.5
2,459,497 A * 1/1949 Calabro ..... A47C 21/022 24/72.5
4,662,016 A * 5/1987 Seeman ..... A47C 21/022 24/72.5
4,782,543 A * 11/1988 Hutton ..... A47C 27/085 24/72.5
5,467,491 A * 11/1995 Griffith ..... A47C 21/022 24/72.5
6,295,670 B1 * 10/2001 Schieberl ..... A47C 21/022 24/72.5
6,457,194 B1 * 10/2002 Bennett ..... A47C 21/022 24/72.5
6,789,295 B1 * 9/2004 Svensson ..... F16B 2/14 24/136 L
6,907,628 B2 * 6/2005 El Guermaai ..... A47C 21/022 24/72.5
7,152,260 B2 * 12/2006 Ota ..... A47C 21/022 24/72.5

(Continued)

*Primary Examiner* — Jason W San
*Assistant Examiner* — Louis A Mercado
(74) *Attorney, Agent, or Firm* — The Van Winkle Law Firm; William G. Heedy

(57) ABSTRACT

A bed cover retention apparatus (10) has an elastic band (14), a clip (16), and a planar strip (12), the planar strip having a first (interior, insertion) end (26), a second (extraction, distal) end (28), a first surface, and a second surface. The first surface and/or the second surface may be a high friction surface (24), or may be a smooth surface having a high friction material (24) attached thereto. The elastic band is connected to the first end, extends along the planar strip toward the second end, and is connected to the clip. An optional extraction hole (20), an optional extraction ridge (22), and/or an optional flare (54) may be provided. The planar strip may be tapered smaller in width from the second end to the first end.

18 Claims, 7 Drawing Sheets

(56) References Cited

U.S. PATENT DOCUMENTS

| | | | | |
|---|---|---|---|---|
| 7,467,428 | B2 * | 12/2008 | Hanes | A47C 21/022 24/72.5 |
| 7,698,759 | B1 * | 4/2010 | Frasier | A47C 21/022 24/72.5 |
| 8,745,787 | B1 * | 6/2014 | Heimlich | A47C 21/022 5/659 |
| 9,055,830 | B2 * | 6/2015 | Tzur | A47C 21/022 |
| 9,591,929 | B1 * | 3/2017 | Surman | A47C 21/02 |
| 10,543,772 | B1 * | 1/2020 | Muri | F16B 2/185 |
| 10,617,219 | B2 * | 4/2020 | Lowe | A47C 21/022 |
| D939,947 | S * | 1/2022 | Gunnarsson | D8/394 |
| 2017/0202361 | A1 * | 7/2017 | White | A47C 21/022 |

* cited by examiner

BED COVER RETENTION APPARATUS

CROSS REFERENCE TO RELATED APPLICATIONS

The present application is a Continuation-in-part Application of U.S. Nonprovisional patent application Ser. No. 16/990,700 filed Aug. 11, 2020, now U.S. Pat. No. 11,382,435 issued Jul. 12, 2022, entitled "BED COVER RETENTION APPARATUS", and which is incorporated herein in its entirety.

BACKGROUND

A smooth-looking bed cover gives an impression of neatness and attention to detail. To achieve that look, the bottom sheet that covers the mattress is often a fitted sheet, meaning that it has elastic at the corners, and sometimes along the top and bottom edges and sides. When the bottom sheet is taut, the upper sheet and any additional bed covers, such as blankets and spreads, will have a smooth, unwrinkled appearance. If, however, the bottom sheet is loose it can bunch or wrinkle, and this can result in the topmost bed cover, such as a spread, having sags and wrinkles and a less than desirable appearance.

Moreover, a smooth-looking bed cover is typically desirable from the perspective of a user in terms of comfort. A bunched or wrinkled bottom sheet can be uncomfortable for a user to lay upon.

In addition, bottom sheets are made to fit various sized mattresses according to their top surface dimensions such as twin, double, queen and king. However, even though these sheets fit the top surface dimensions, the depth of mattresses varies substantially and the manufactured pockets composing the vertical sides of these "fitted" sheets must be tall enough to accommodate the maximum mattress depth or the fitted sheets will quickly rise up on the mattress and become loose fitting. Further, if the pocket is made for a thick mattress but is actually used on a less thick mattress then the fitted sheet will initially have a loose fitting. Also, the fitted sheets may become loose as they stretch during use. The result is a loose, wrinkly and wavy bottom sheet which can result in the topmost bed cover having sags and wrinkles, therefore resulting in a less than desirable appearance and feel for the user. Thus, frequent manual re-stretching and re-tucking of the fitted sheet is required in order to maintain the desired appearance.

Various devices have been proposed to assist in maintaining that tightly-fitted look. Elastic straps, installed on the underside of the mattress, attempt to maintain both initial tension on the sheet and continued tension as the sheet moves and stretches. These elastic strap systems, however, require tedious lifting and displacement of the mattress to install and reconnect the elastic straps. Rigid clips are less difficult to use than the above-mentioned elastic straps but they do not maintain tension on the sheet as it moves and stretches. There are also belt type elastic bands that encircle the vertical perimeter of the mattress. These are also difficult to install, have an unsightly appearance, and fail to maintain a smooth surface as the sheet moves and stretches.

SUMMARY

An improved bed cover retention apparatus is described.

The bed cover retention apparatus has a planar strip, an elastic band, and a clip. The planar strip has a high friction first surface, an opposing second surface, an inserted end, and a distal end. The elastic band is interposed between, and connected to, the inserted end of the planar strip and the clip. The first surface may be a lower surface, and the second surface may be a smooth upper surface.

DETAILED DESCRIPTION

Figure 1:
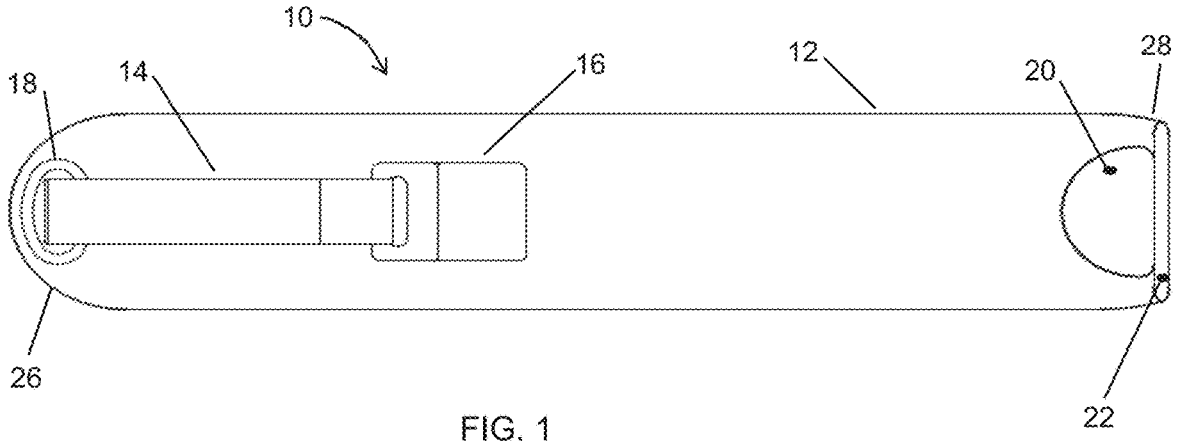
FIG. 1 is a top view of a bed cover retention apparatus.
Figure 2:
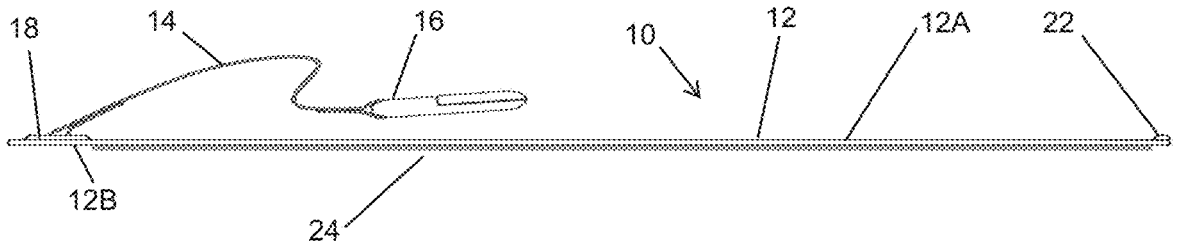
FIG. 2 is a side view of the bed cover retention apparatus.
Figure 3:
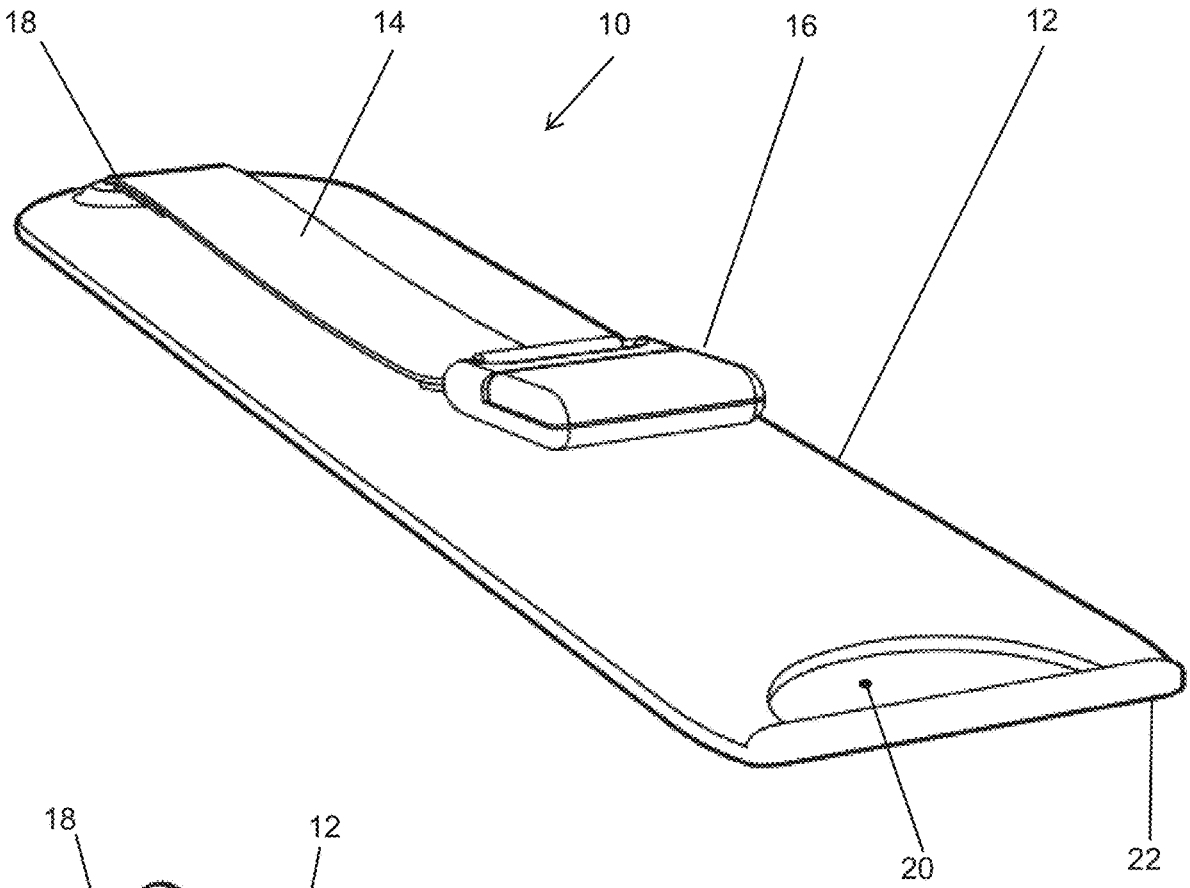
FIG. 3 is a top perspective view of the bed cover retention apparatus.
Figure 4:
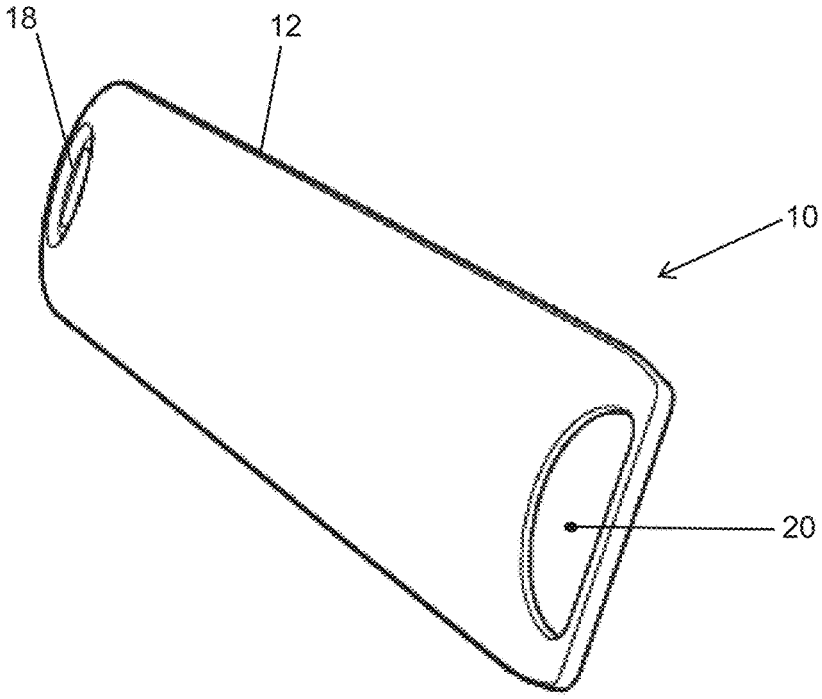
FIG. 4 is a bottom perspective view of the bed cover retention apparatus.

FIGS. 1, 2, 3, and 4 are top, side, top perspective, and bottom perspective views, respectively, of a bed cover retention apparatus 10, showing a planar strip 12 having a first (interior, insertion) end 26, a second (extraction, distal) end 28, a body, an elastic band 14, a clip 16, a first hole 18, a layer of a flexible material 24, an optional second hole 20, and an optional retraction lip or ridge 22.

Figure 5A:
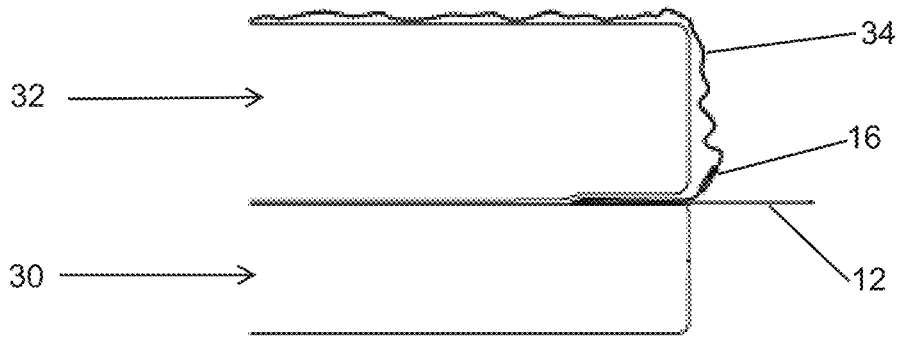
FIGS. 5A to 5C are an illustration of the installation of the bed cover retention apparatus.
Figure 5B:
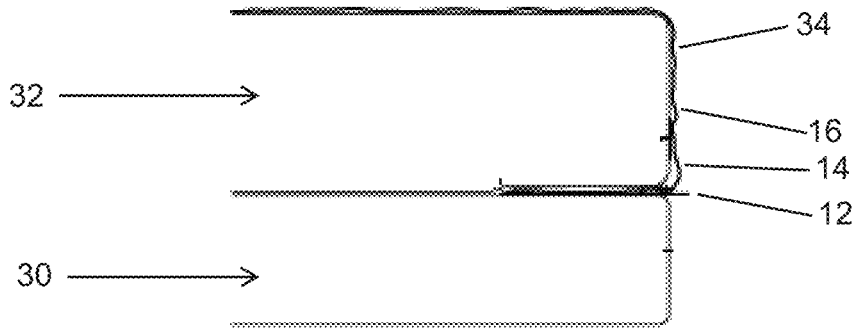
Figure 5C:
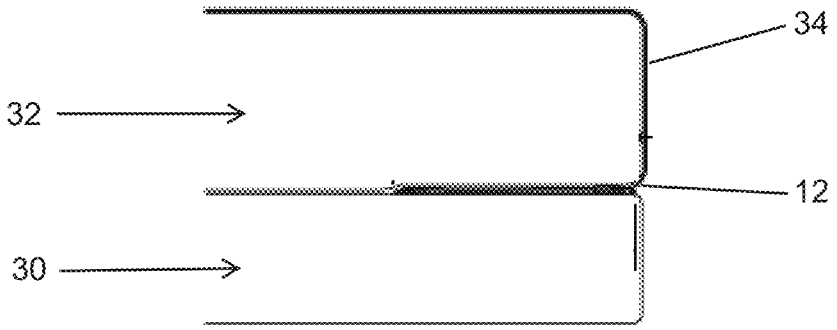

FIGS. 5A to 5C are an illustration of the installation of the bed cover retention apparatus 10. The insertion end 26 of the planar strip 12 is inserted between the upper mattress 32 and the wooden base or box spring or lower mattress 30 (referred to hereinafter as the "box spring" to avoid having to repeatedly list the box spring and the lower mattress in the alternative) and the clip 16 is attached to an edge of the sheet 34, which is preferably, but not necessarily, a fitted sheet. The planar strip 12 is then pushed further between the mattress 32 and box spring 30, which causes tension to be placed on the sheet 34. The planar strip 12 is then pushed further between, or completely between, the mattress 32 and box spring 30, so that, preferably, but not necessarily, little or none of the distal, extraction end 28 is showing, thereby maximizing the tension placed on the sheet 34 and causing the sheet 34 to have a taut, smooth-looking appearance and smooth feel.

Removal is accomplished by the reverse process, pulling the planar strip 12 at least partially from between the box spring 30 and the mattress 32, and unhooking the clip 16 from the sheet 34. If another sheet 34 is to be used, then the clip 16 is attached to the sheet 34 and the planar strip 12 is then pushed back between the box spring 30 and the mattress 32. If, however, another sheet 34 is not to be immediately used, such as if the mattress 32 is to be flipped or rotated, then the planar strip 12 is pulled completely out from between the box spring 30 and the mattress 32.

Figure 6:
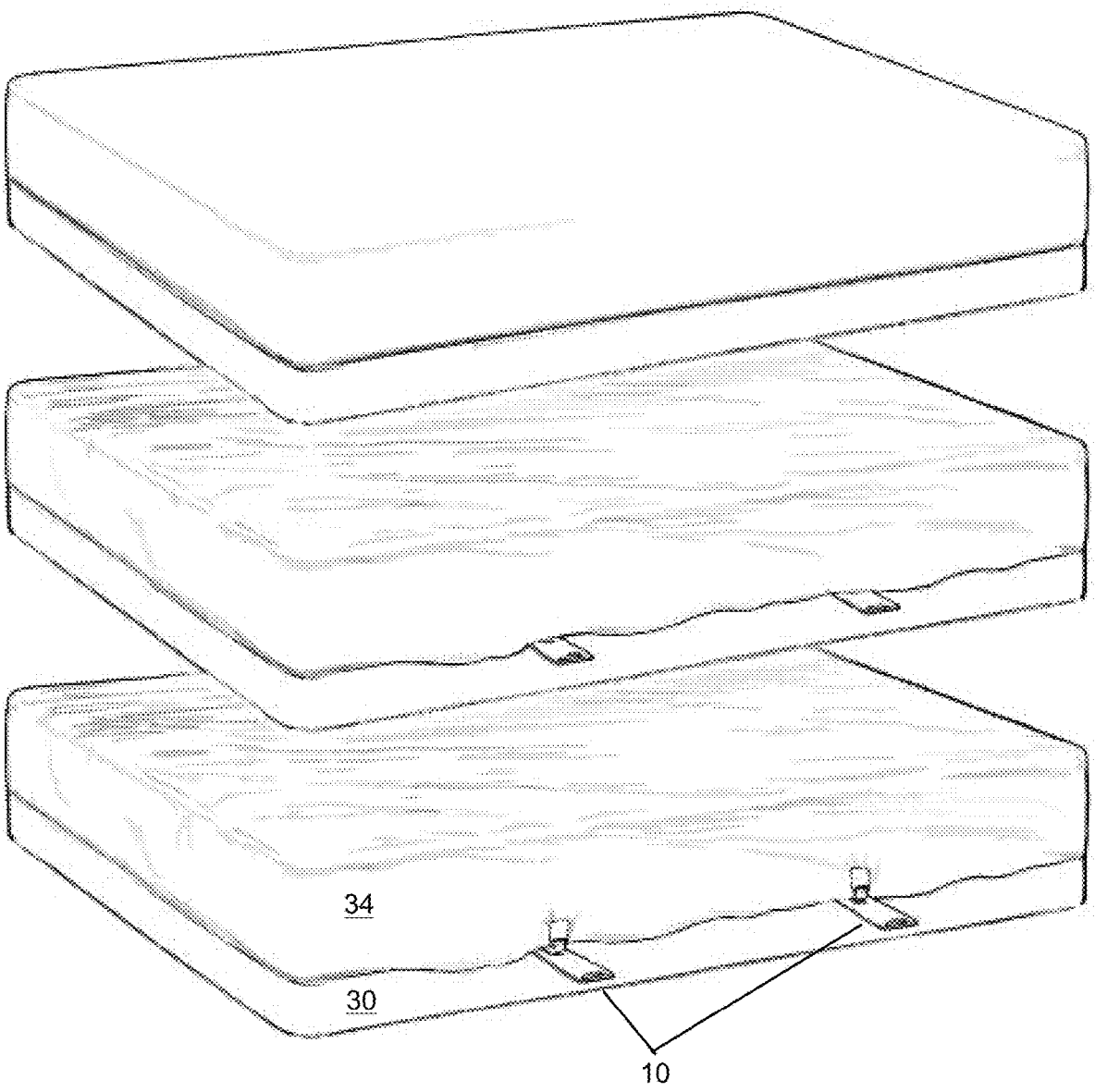
FIG. 6 is another illustration of the installation of the bed cover retention apparatus.

FIG. 6 is another illustration of the installation of the bed cover retention apparatus 10, corresponding, from the bottom up, to FIGS. 5A-5C, respectively.

Referring again to FIGS. 1-4, the planar strip 12 preferably has a surface 12B and an opposing surface 12A. The surface 12B may covered by a flexible material 24 which provides a high friction surface, or surface 12B itself may be a high friction surface, such as a rough surface, in which case the flexible material 24 might not be used. The high friction surface provides enough friction between the planar strip 12 and the box spring 30 to prevent the tension of the elastic band 14 from pulling the planar strip 12 out from its deeply-seated position between the mattress 32 and the box spring 30. This friction is not so great however that a user cannot pull the planar strip 12 out without damaging the cover of the box spring 30. An example of a suitable material for the flexible material 24 is Product No. ALQR001A made by Riken Elastomers Corp. Other materials may also be used. In an embodiment the flexible material 24 has a rectangular pattern thereon. Other patterns may also be used provided that they provide the desired degree of friction with respect to the box spring 30.

In an implementation, the planar strip 12 is a rigid planar strip. In another implementation, the planar strip 12 is rigid enough to allow it to be pushed between the box spring 30 and the mattress 32.

In an implementation, the upper surface 12A is a smooth surface. In another implementation, the upper surface 12A provides additional friction to help hold the bed cover retention apparatus 10 in place.

In an implementation, the planar strip 12 has a length of between approximately 12 inches and 24 inches. In an implementation, the planar strip 12 has a length of between approximately 15 inches and 20 inches.

In an implementation, the planar strip 12 has a uniform width of between approximately 2 inches and 4 inches. In an implementation, the planar strip 12 has a uniform width of between approximately 3 inches and 4 inches. In another implementation, the planar strip 12 may taper so that the inserted end is smaller than the distal end.

In an implementation, the planar strip 12 has an extraction hole 20, which provides the user with a convenient way to grasp and extract the planar strip 12 that has been inserted between the mattress 32 and the box spring 30. In another implementation, the planar strip 12 does not have an extraction hole 20.

In an implementation, the planar strip 12 has an extraction lip or ridge 22, which provides the user with a convenient way to grasp and extract the planar strip 12 that has been inserted between the mattress 32 and the box spring 30. In another implementation, the planar strip 12 does not have an extraction lip.

In an implementation, the inserted end of the planar strip 12 is rounded or curved. In another implementation, the inserted end of the planar strip 12 is substantially squared.

Figure 7:
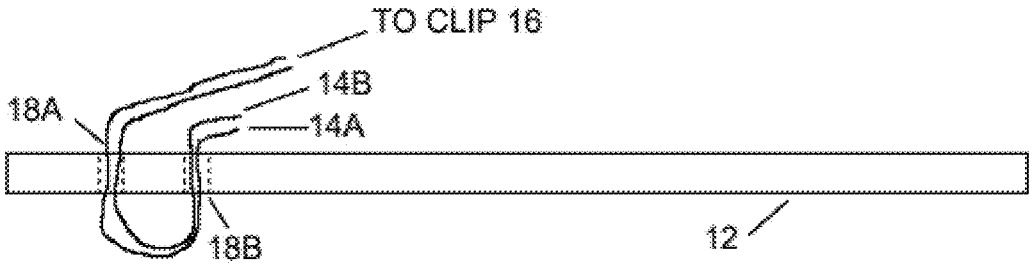
FIG. 7 is an illustration of an exemplary retaining hole to secure an elastic band.

In an implementation a plug fits into the retaining hole 18 and the elastic band 14 is secured to the plug. In another implementation, as seen in FIG. 7, the retaining hole 18 comprises first and second slots 18A, 18B, and the elastic band 14 is routed through the slots 18A, 18B. One end 14A of the elastic band 14 is routed through slot 18A and then through slot 18B, and the other end 14B of the elastic band 14 is also routed through slot 18A and then through slot 18B.

Figure 8:
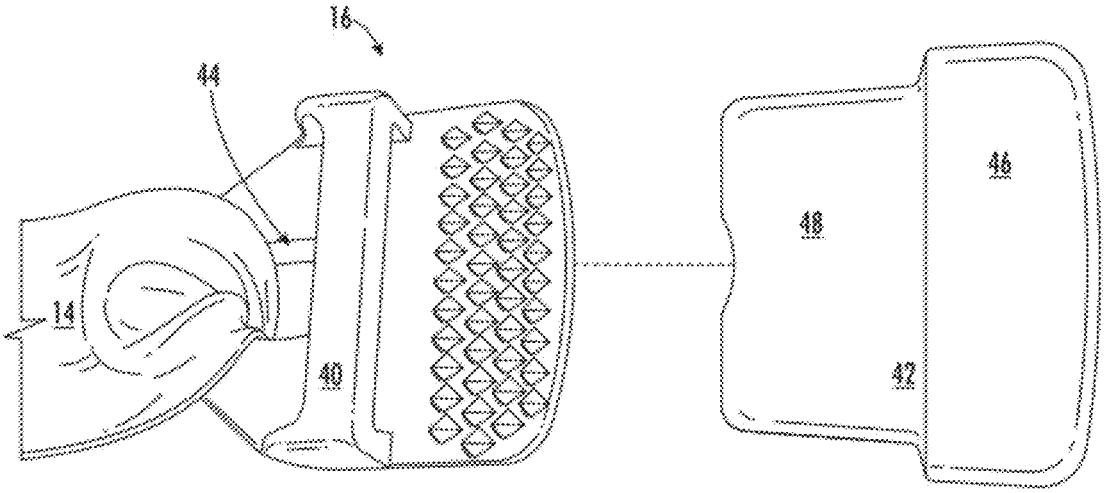
FIG. 8 is an illustration of an exemplary clip.

FIG. 8 is an illustration of an exemplary clip 16 to secure the elastic band 14. The clip 16 has a body portion 40 and an insert portion 42. The body portion 40 has a hole or aperture 44 through which the elastic band 14 is routed. The insert portion 42 has a head end 46 and a tapered end 48. In use, an edge of the sheet 34 is placed against the body portion 40 and the insert portion 42 is pushed into the body portion 40, thereby securing the sheet 34 to the clip 16. Alternatively, an edge of the sheet 34 may be routed around the tapered end 48, and then the insert portion 42 is pushed into the body portion 40, thereby securing the sheet 34 to the clip 16. For more details regarding the construction of the clip 16, please see U.S. Pat. No. 6,789,295 to Svensson, the disclosure and teachings of which are hereby incorporated herein by reference. Other types of clips may also be used but care should be taken that the clip selected does not damage the sheet 34.

Figure 9:
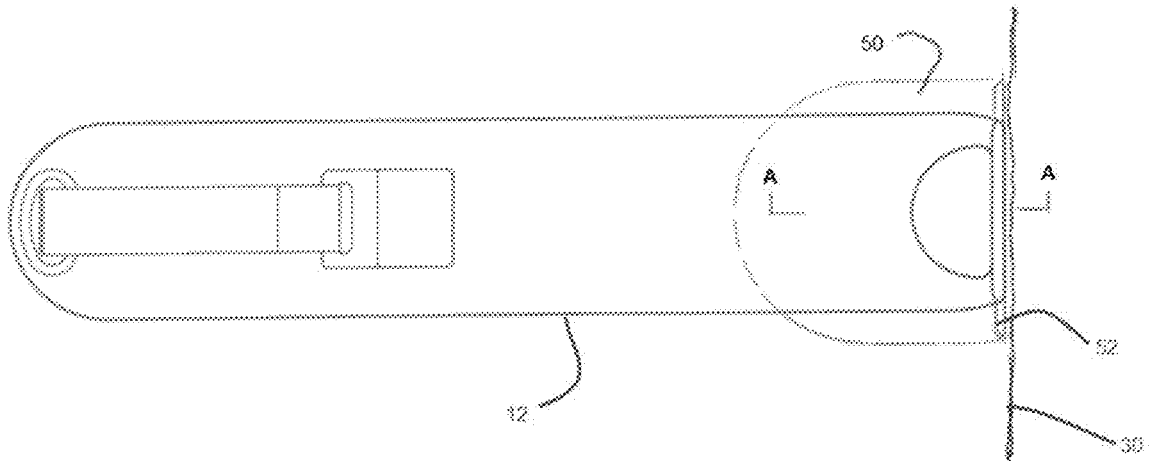
FIG. 9 is a top view of a bed cover retention apparatus.
Figure 10:
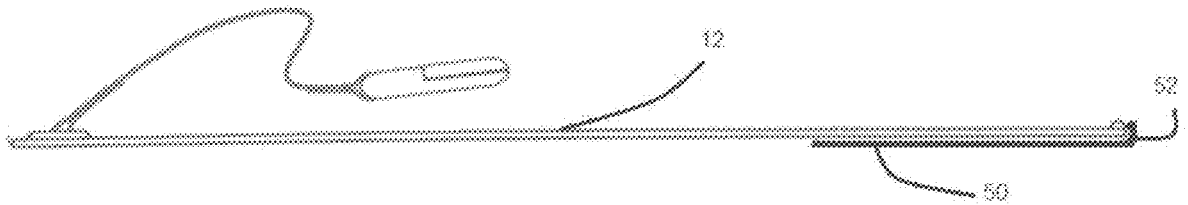
FIG. 10 is a side view of the bed cover retention apparatus of FIG. 9.
Figure 11:
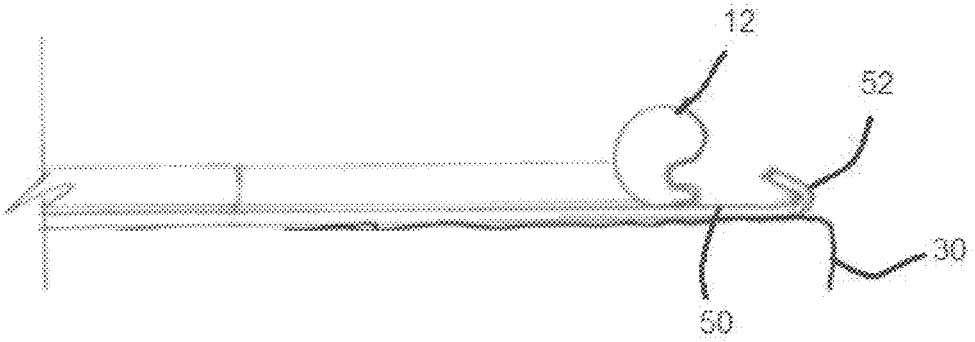
FIG. 11 is cross sectional view of the bed cover retention apparatus taken along line A-A in FIG. 9.

FIGS. 9-11 illustrate an embodiment of the bed cover retention apparatus 10 including a retainer 50 including a protrusion 52, such as a hook, that may be affixed to the box spring 50. The retainer 50 may be affixed to the box spring 30 in one or more ways, including, but not limited to, using an adhesive, screw or nail. In this implementation, the planar strip 12 is sized and configured to be selectively, releasably secured to the retainer 50 such that, when the sheet 34 is secured to the planar strip 12, tension is applied to the sheet 34, thereby causing the sheet 34 to have a taut, smooth-looking appearance and smooth feel. It is also considered that the retainer 50 may be affixed to the bottom surface of the mattress 32 to achieve the same objective.

Figure 12:
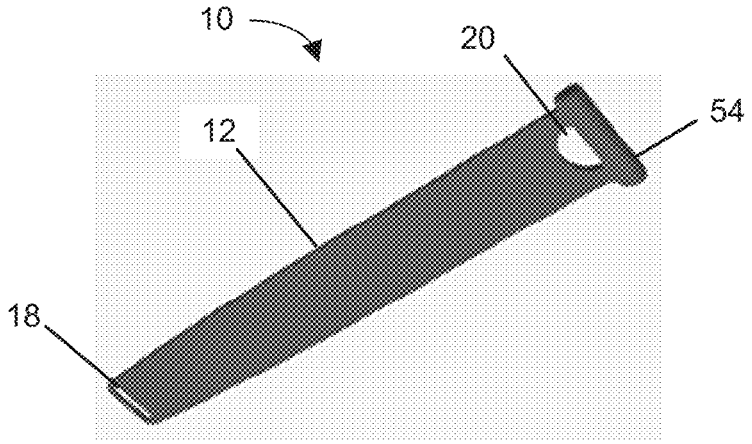
FIGS. 12-14 are illustrations of another embodiment of the apparatus.
Figure 13:
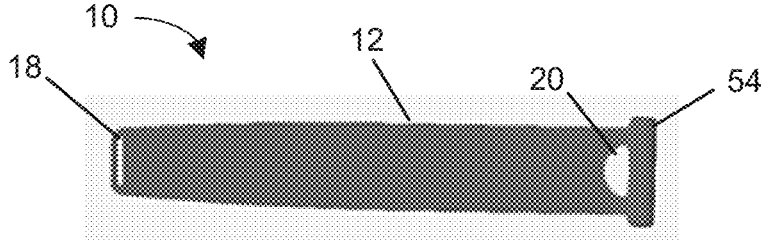
Figure 14:
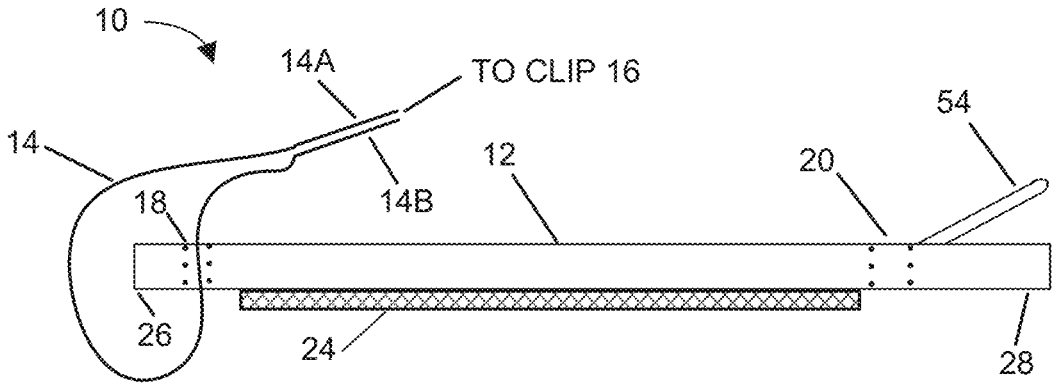

FIGS. 12-14 are illustrations of another embodiment of the apparatus 10 wherein the planar strip 12 has a first end 26, a second end 28, and a body. The planar strip 12 may be tapered smaller in width from the second end 28 to the first end 26. The taper provides for easier insertion and removal of the apparatus 10. The second end 28 is preferably, but not necessarily, flared, such as may be accomplished by an extension arm 54. The flare along with the hole 20 provides for easier grasping for insertion and removal of the apparatus 10. In addition, most mattresses 32 and box springs 30 have a lip or seam (not shown) around the top and/or bottom of the circumference and the flare engages the lip or seam to more securely hold the apparatus 10 in place, while still allowing for easy removal by simply moving the apparatus 10 up or down to disengage the flare from the lip or seam.

The elastic strip 14 is routed through the insertion slot 18, along the planar strip 12 toward the second end 28, and connects to the clip 16 (see, e.g., FIGS. 1-3 and 8). When the apparatus 10 is inserted between the mattress 32 and box spring 30 the segments 14A, 14B of the elastic strip 14 are forced against each other, and segment 14B is forced against the planar strip 12. This provides resistance to the elastic strip 14 being pulled outwardly from the mattress 32 and box spring 30. This serves to maintain the tension on the bed cover. If desired, the length of the elastic strip 14 may be adjusted, such as by using a G-hook or D-ring slide adjuster between slot 18 and clip 16.

Certain bed frame structures have an extended bed frame rail, which extends above the base of the mattress 32 supported thereon. In such instances, the apparatus 10 may be used without the retainer 50, as the extended bed frame rail is sufficient for restraining the planar strip 12 in an operational position.

In an embodiment, a surface of planar strip 12 may be a high friction surface to provide resistance to the apparatus 10 being unintentionally pulled outwardly. The upper surface, the lower surface, or both, may be high friction surfaces.

In an embodiment, an optional high friction material may be attached to a surface of planar strip 12. The high friction material may be attached to the upper surface, the lower surface, or both.

In an embodiment, one surface of the planar strip 12 may be a high friction surface and the other surface of the planar strip 12 is a smooth surface to which a high friction material is attached.

The numeral 24 refers to optional high friction material if used, or to the high friction surface of the planar strip 12 if the optional high friction material is not used.

Thus, in an embodiment, the bed cover retention apparatus 10 has a planar strip 12 having a first end 26 and a second end 28, a clip 16, and an elastic band 14 connected to the first end 26, extending along the planar strip 12 toward the second end 28, and connected to the clip 16.

In an embodiment, the bed cover retention apparatus 10 has a planar strip 12 having a first end 26, a second end 28, and a hole 18 near the first end 26, a clip 16, and an elastic band 14 routed through the hole 18, extending along the planar strip 12 toward the second end 28, and connected to the clip 16.

In an embodiment, the bed cover retention apparatus 10 has a planar strip 12 having an upper surface, a lower surface, a first end 26, a second end 28, an extraction hole 20 near the second end 28, and a flare near the second end 28, a clip 16, and an elastic band 14 connected to the first end 26, extending from the first end 26 along the planar strip 12 toward the second end 28, and connected to the clip 16.

The disclosed bed cover retention apparatus 10 may therefore be positioned to be out of sight, provides for ease of installation, provides for ease of removal, and maintains a constant tension on the sheet as it moves and stretches during use.

Also, it will be appreciated that when a person sits or lays upon the mattress 32, the weight of that person will cause tension to be exerted on the elastic band 16. That same weight, however, presses the mattress 32 and the box spring 30 more tightly against the planar strip, thereby increasing the frictional force which prevents the planar strip 12 from being pulled outwardly.

Unless otherwise defined, all terms (including technical and scientific terms) used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments are contemplated, described herein, and set forth in the claims.

For convenience of discussion herein, when there is more than one of a component, that component may be referred to herein either collectively or singularly by the singular reference numeral unless expressly stated otherwise or the context clearly indicates otherwise. For example, components N (plural) or component N (singular) may be used unless a specific component is intended. Also, the singular forms "a," "an," and "the" are intended to include the plural forms as well, unless expressly stated otherwise or the context indicates otherwise.

It will be further understood that the terms "includes," "comprises," "including," and/or "comprising" specify the presence of stated features, steps, operations, elements, and/or components, but do not preclude the presence or addition of one or more other features, steps, operations, elements, components, and/or groups thereof unless explicitly stated otherwise or the context clearly requires otherwise. The terms "includes," "has" or "having" or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled or coupled by one or more intervening components unless expressly stated otherwise or the context clearly indicates otherwise.

The term "and/or" includes any and all combinations of one or more of the associated listed items. As used herein, phrases such as "between X and Y" and "between about X and Y" should be interpreted to include X and Y unless expressly stated otherwise or the context clearly indicates otherwise.

Terms such as "about", "approximately", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While the terms vertical, horizontal, upper, lower, bottom, top, and the like may be used herein, it is to be understood that these terms are used for ease in referencing the drawing and, unless otherwise indicated or required by context, does not denote a required orientation.

The different advantages and benefits disclosed and/or provided by the implementation(s) disclosed herein may be used individually or in combination with one, some or possibly even all of the other benefits. Furthermore, not every implementation, nor every component of an implementation, is necessarily required to obtain, or necessarily required to provide, one or more of the advantages and benefits of the implementation.

Conditional language, such as, among others, "can", "could", "might", or "may", unless specifically stated otherwise, or otherwise understood within the context as used, is generally intended to convey that certain embodiments preferably or optionally include certain features, elements and/or steps, while some other embodiments optionally do not include those certain features, elements and/or steps. Thus, such conditional language indicates, in general, that those features, elements and/or step may not be required for every implementation or embodiment.

The subject matter described herein is provided by way of illustration only and should not be construed as limiting the nature and scope of the subject invention. While examples of aspects of the subject invention have been provided above, it is not possible to describe every conceivable combination of components or methodologies for implementing the subject invention, and one of ordinary skill in the art may recognize that further combinations and permutations of the subject invention are possible. Furthermore, the subject invention is not necessarily limited to implementations that solve any or all disadvantages which may have been noted in any part of this disclosure. Various modifications and changes may be made to the subject invention described herein without following, or departing from the spirit and scope of, the exemplary embodiments and applications illustrated and described herein. Although the subject matter presented herein has been described in language specific to components used therein, it is to be understood that the subject invention is not necessarily limited to the specific components or characteristics thereof described herein; rather, the specific components and characteristics thereof are disclosed as example forms of implementing the subject invention. Accordingly, the disclosed subject matter is intended to embrace all alterations, modifications, and variations, that fall within the scope and spirit of any claims that are written, or may be written, for the subject invention.

The foregoing detailed description is intended only to convey to a person having ordinary skill in the art the fundamental aspects of the invention and is not intended to limit, and should not be construed as limiting, the scope of the invention.

The invention claimed is:

1. A bed cover retention apparatus comprising:
a planar strip having a first end and a second end;
wherein the planar strip has an extension arm extending from the second end, the extension arm being provided for grasping for insertion and removal of the apparatus;
a clip; and
an elastic band connected to the first end, extending along the planar strip toward the second end, and connected to the clip.

2. The bed cover retention apparatus of claim 1, wherein at least a portion of the planar strip tapers smaller in width from the second end to the first end.

3. The bed cover retention apparatus of claim 1, wherein the planar strip has an extraction hole near the second end.

4. The bed cover retention apparatus of claim 1, wherein the planar strip has an upper surface and a lower surface, and at least one of the upper surface or the lower surface is a high friction surface.

5. The bed cover retention apparatus of claim 1, wherein the planar strip has an upper surface and a lower surface, and further comprising a high friction material attached to at least one of the upper surface or the lower surface.

6. The bed cover retention apparatus of claim 1, wherein the clip comprises:
a body component and a wedge component;
the body component having a first end, a second end, and a central portion, the first end being attached to the elastic band, the second end having a rough surface, the central portion having a loop; and
the wedge component having a first end and a second end, the first end being sufficiently thin to fit through the loop, the second end being sufficiently thick to stop the wedge component from being pushed through the loop.

7. The bed cover retention apparatus of claim 6, wherein the rough surface of the second end of the body component comprises a plurality of protuberances.

8. The bed cover retention apparatus of claim 6, wherein the rough surface of the second end of the body component comprises a plurality of shallow teeth oriented toward the loop.

9. A bed cover retention apparatus comprising:
a planar strip having a first end, a second end, and a hole formed on the first end;
wherein the planar strip has an extension arm extending from the second end, the extension arm being provided for grasping for insertion and removal of the apparatus;
a clip; and
an elastic band routed through the hole, extending along the planar strip toward the second end, and connected to the clip.

10. The bed cover retention apparatus of claim 9, wherein at least a portion of the planar strip tapers smaller in width from the second end to the first end.

11. The bed cover retention apparatus of claim 9, wherein the planar strip has an extraction hole near the second end.

12. The bed cover retention apparatus of claim 9, wherein the planar strip has an upper surface and a lower surface, and at least one of the upper surface or the lower surface is a high friction surface.

13. The bed cover retention apparatus of claim 9, wherein the clip comprises:
a body component and a wedge component;
the body component having a first end, a second end, and a central portion, the first end being attached to the elastic band, the second end having a rough surface, the central portion having a loop; and
the wedge component having a first end and a second end, the first end being sufficiently thin to fit through the loop, the second end being sufficiently thick to stop the wedge component from being pushed through the loop.

14. The bed cover retention apparatus of claim 13, wherein at least one of:
the rough surface of the second end of the body component comprises a plurality of protuberances; or
the rough surface of the second end of the body component comprises a plurality of shallow teeth oriented toward the loop.

15. A bed cover retention apparatus comprising:
a planar strip having an upper surface, a lower surface, a first end, a second end, an extraction hole formed on the second end, and an extension arm extending from the second end, the extension arm being provided for grasping for insertion and removal of the apparatus;
a clip; and
an elastic band connected to the first end, extending from the first end along the planar strip toward the second end, and connected to the clip.

16. The bed cover retention apparatus of claim 15, wherein at least one of:
the upper surface is a high friction surface; or
the lower surface is a high friction surface.

17. The bed cover retention apparatus of claim 15, wherein at least one of:
a high friction material is attached to the upper surface; or
a high friction material is attached to the lower surface.

18. The bed cover retention apparatus of claim 15, wherein the clip comprises:
a body component and a wedge component;
the body component having a first end, a second end, and a central portion, the first end being attached to the elastic band, the second end having a rough surface, and the central portion having a loop; and
the wedge component having a first end and a second end, the first end being sufficiently thin to fit through the loop, the second end being sufficiently thick to stop the wedge component from being pushed through the loop; and
wherein the rough surface comprises either:
a plurality of protuberances; or
a plurality of shallow teeth oriented toward the loop.

* * * * *